United States Patent [19]

Daniels et al.

[11] 4,333,540

[45] Jun. 8, 1982

[54] CUTTER ELEMENT AND CUTTER FOR ROCK DRILLING

[75] Inventors: William H. Daniels, Delaware, Ohio; John B. Cheatham, Jr., Houston, Tex.

[73] Assignee: General Electric Company, Worthington, Ohio

[21] Appl. No.: 120,021

[22] Filed: Feb. 11, 1980

Related U.S. Application Data

[63] Continuation of Ser. No. 947,865, Oct. 2, 1978, abandoned.

[51] Int. Cl.[3] ..... E21B 10/46

[52] U.S. Cl. ..... 175/329; 175/410

[58] Field of Search ..... 175/410, 411, 412, 413, 175/329

[56] References Cited

U.S. PATENT DOCUMENTS

| | | | |
|---|---|---|---|
| 1,487,217 | 3/1924 | Dillon | 299/79 |
| 1,544,757 | 7/1925 | Hafford et al. | 175/413 |
| 3,743,489 | 7/1971 | Wentorf, Jr. et al. | 51/307 |
| 3,745,623 | 7/1973 | Wentorf, Jr. et al. | 29/95 B |
| 4,076,318 | 2/1978 | Haaschopp et al. | 299/91 |
| 4,110,084 | 8/1978 | Lee et al. | 51/309 R |
| 4,143,920 | 3/1979 | Haddock | 175/410 |

FOREIGN PATENT DOCUMENTS

| | | |
|---|---|---|
| 449974 | 4/1935 | United Kingdom . |
| 944893 | 4/1961 | United Kingdom . |
| 1443092 | 7/1976 | United Kingdom . |

*Primary Examiner*—James A. Leppink

*Attorney, Agent, or Firm*—Douglas B. Little; William S. Feiler

[57] ABSTRACT

A fixed cutting tool shape for improved rock drilling performance of drag-type rotary bits includes a cemented tungsten carbide cutter body and a plow-shaped cutter element. In a preferred embodiment, the cutter element is a composite compact of polycrystalline diamond on a cemented tungsten carbide substrate, and defines a generally V-shaped cutter to create a plowing action and direct rock ship flow away from the working surface.

2 Claims, 3 Drawing Figures

CUTTER ELEMENT AND CUTTER FOR ROCK DRILLING

This is a continuation of application Ser. No. 947,865, filed Oct. 2, 1978, now abandoned.

BACKGROUND OF THE INVENTION

This invention relates to oil and rock drilling bits and, more particularly, to the use of composite compacts of diamond, cubic boron nitride (CBN), or wurtzite boron nitride (WBN) in shaped configurations for use as cutting elements for rock drilling.

Drag type rotary bits are commonly fabricated using natural diamond crystals. These bits are used for hard abrasive drilling in deep formations. Such drilling is typically characterized by slow penetration rates (2 to 4 ft./hr.) and long bit life (up to 300 hrs.). Because of the thermal sensitivity of diamonds and the necessity for cooling and cleaning of the individual cutters, good fluid hydraulics are essential to economic bit performance. To obtain acceptable levels of bit hydraulics, diamond bit fabricators have historically used low cutter exposure levels of the individual diamond stones. Conventional diamond drag bits contain individual surface set stones which have exposures or engagements into the rock of the order of 1/16 inch maximum.

It has been recently proposed to use synthetic diamond compacts both cluster and composite as the cutting elements in rotary bits. Such compacts are preferably made in accordance with U.S. Pat. No. 3,745,623.

The advent of such drill blanks, e.g., a sintered diamond layer intimately bonded to a cobalt cemented tungsten carbide layer, has provided a rock cutting tool which permits much more aggressive cutting of hard sandy shales and other abrasive formations. Although drag bits fabricated from these diamond compact blanks are capable of faster penetration rates and equivalent or longer life than diamond drag bits, achievement of optimum performance is often limited by the adherence of the shale, which is under confining pressure, to the sintered diamond cutting surface. Such sticking or loading up of the individual cutters leads to reduced penetration rates and overheating of the cutters, thereby creating reduced abrasion resistance and shortened bit life.

Drag bits fabricated using diamond compacts have historically exhibited much higher exposure levels and thus greater potential engagement of the rock workpiece. These cutters are known to machine the rock which exhibits plastic deformation under the confining pressures which exist at typical well depths of 5,000 to 15,000 or more feet. These cutters are placed on the bit usually at a negative 5° to negative 25° angle of rake of the cutting edge. The cutting edges are usually round or straight and the chips of plastic rock are forced up the flat surface of the sintered diamond layer. In order to provide cleaning and cooling of this sintered diamond surface, necessary to maintain a sharp cutting edge, the bit is designed to channel the drilling mud in a sweeping mode across the cutter surface. In practice it is usually difficult to provide this type of hydraulic action when the desired cutter exposure of ¼ inch or more is present.

SUMMARY OF THE INVENTION

A cutter of the present invention overcomes the drawbacks of the prior art with the use of a pre-selected cutter shape geometry which creates a plowing action against the plastic rock chips. The cutter includes a plow shaped cutting element, preferably a cutting element of composite compact having a generally V-shaped plow geometry. The included angle of the V-shaped element is advantageously in the range of 60° to 90°, most advantageously about 75°. The cutter element may be fabricated from diamond compacts and subsequently bonded to the bit or to a cutter body for later attachment to the bit by any of the conventional attachment techniques.

The cutter element geometry of this invention permits maintaining aggressive cutting action and longer cutter life by eliminating the tendency for cutters to load up or become occluded by the sticky plastic shales. By generating a rock chip flow which inherently moves away from the cutter surface rather than building up on the cutter surface, the critical requirements for bit hydraulics are reduced. This permits maintenance of maximum cutter exposure and associated high penetration rates for the rock drilling operation.

DETAILED DESCRIPTION OF PREFERRED EMBODIMENT

Figure 3:
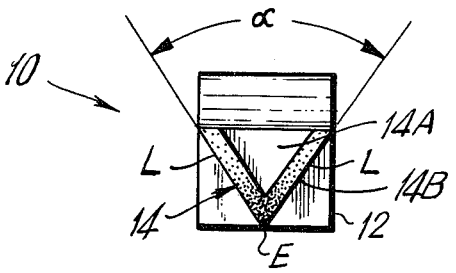
FIG. 3 is a schematic top plan view of the cutter.

While this invention is susceptible of embodiment in many different forms there is shown in the drawings and will hereinafter be described in detail a preferred embodiment of the and alternative thereto, with the understanding that the present disclosure is to be considered as an exemplification of the principles of the invention and is not intended to limit the invention to the embodiment illustrated.

Figure 1:
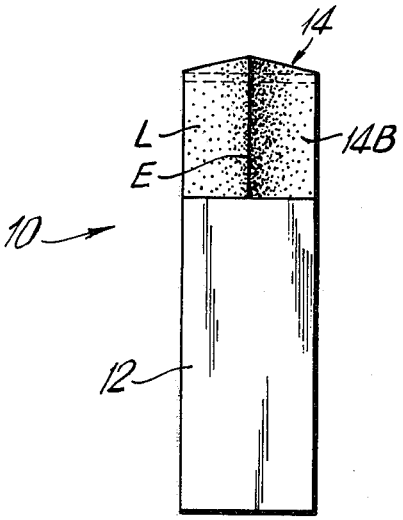
FIG. 1 is a schematic front elevation view of an exemplary cutter and cutter element for drag-type bits in accordance with the present invention.
Figure 2:
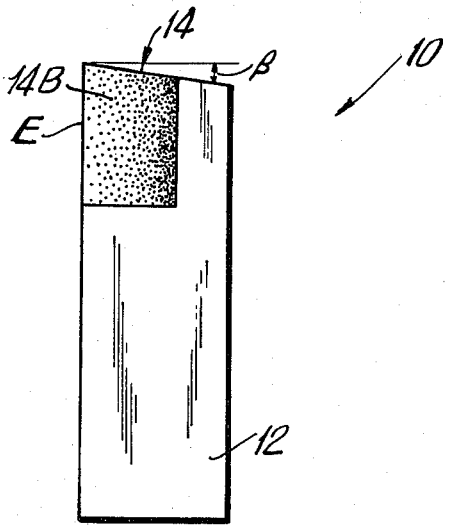
FIG. 2 is a schematic side elevation view of the cutter.

FIG. 1 shows a cutter 10 of the present invention. Cutter 10 includes a body portion 12 and a cutting element 14. Body portion 12, while illustrated as being generally rectangular in cross-section, may be of any convenient shape for mounting on a drag-type bit for oil and gas drilling in various strata formations. In use, a plurality of cutters 10 or individual cutter elements 14 or both would be attached to the drill crown of a rotary bit at suitable rake angles for the intended drilling.

It has been discovered that by providing cutter 10 with a shaped cutting surface, the cutting surface tends to plow the rock away from the working surface of the cutter. The plowing action reduces substantially or eliminates the loading of the cutter with attendant increase in penetration rates and reduced heating of the cutters.

As shown in the drawings, the shaping of the cutter surface is achieved by providing a triangular shaped cutter element 14 having a generally V-shaped cutter surface. The V-shaped surface includes leg portions L which meet at edge E to define an included angle $\alpha$. The included angle surface defined by angle $\alpha$ should be in the range of from 60° to 90°. Most advantageously, the included angle should be about 75°. Depending upon the application, it may be advantageous to provide a set back, relief angle of a few degrees, for example $\beta=7°$.

To maintain the sharp cutting edge E under long drilling times, it is preferable to construct the cutter element 14 with a superabrasive such as cluster compacts or composite compacts of diamond, cubic boron nitride or wurtzite boron nitride or mixtures thereof. However, the plowing effect may be utilized with other materials as well.

A cluster compact is defined as a cluster of abrasive particles bonded together either (1) in a self-bonded relationship, (2) by means of bonding medium disposed between the crystals, (3) by means of some combination of (1) and (2). Reference can be made of U.S. Pat. Nos. 3,136,615; 3,141,746 and 3,233,988 for a detailed disclosure of certain types of compacts and methods for making same. (The disclosures of these patents are hereby incorporated by reference herein.)

A composite compact is defined as a cluster compact bonded to a substrate material such as cemented tungsten carbide. A bond to the substrate can be formed either during or subsequent to the formation of the cluster compact. Reference can be made to U.S. Pat. No. 3,745,623; 3,745,489 and 3,767,371 for a detailed disclosure of certain types of composite compacts and methods of making same. (The disclosures of these patents are hereby incorporated by reference herein.)

The term cemented carbide as used herein means one or more transitional carbides of a metal of Groups IVb, Vb, and VIb of the Periodic Table cemented or bonded by one or more matrix metals selected from the group iron, nickel, and cobalt. A typical cemented carbide contains WC in a cobalt matrix or TiC in a nickel matrix.

Preferably, the V-shaped cutter element 14 is a composite compact which includes a substrate 14A of cemented carbide and an abrasive mass or layer 14B. The abrasive layer, as previously indicated, may be comprised of an abrasive selected from the group consisting of diamond, cubic boron nitride (CBN), wurtzite boron nitride (WBN), and mixtures of two or more of the foregoing.

As illustrated in the drawing, the cutter element 14 includes a triangular cross-sectional substrate 14A of, for example, cobalt cemented tungsten carbide. Substrate 14A may be attached to cutter body 12 by any conventional technique such as brazing by induction heating, or furnacing, or by interference fitting commonly used in full hole oil/gas manufacturing.

Abrasive layer 14B is bonded to two legs of substrate 14A to provide a generally V-shaped surface, as viewed in FIG. 3. This structure provides an elongate working edge E with the angled leg surfaces L providing a plow-life effect on the rock chips. Cutter element 14 may be fabricated in accordance with the above reference U.S. Pat. No. 3,745,623.

Alternatively, the cutter element 14 may be fabricated by bonding two, flat, diamond composite drill blanks together at a suitable angle to form the plow shape and included angle indicated above. Such flat type composite compacts are commercially available from General Electric Company under the designation STRATAPAX ™ Drill Blanks (polycrystalline diamond on a cemented carbide substrate.)

These and other modifications may be made by those skilled in the art without departing from the scope and spirit of the present invention as, pointed out in the appended claims.

Indeed, those skilled in the art will recognize that the method of drilling comprising contacting a stratum formation with a cutting element having a generally V-shaped plow geometry and moving the cutter relative to the strata with the apex as the leading edge causes chip flow to proceed along the plow legs and away from the working edge represents an advance in high penetration drilling.

What is claimed is:

1. An improved drag type oil and rock drill bit having composite compact cutter elements each comprising a polycrystalline layer of diamond cubic boron nitride, wurtzite boron nitride or mixtures thereof bonded to a substrate made of a cemented carbide selected from tantalum, titanium or tungsten carbide, wherein the improvement comprises compact cutting elements having a generally V-shape configuration in which the polycrystalline diamond layer forms the legs of said V-shape, said V-shape defining an included angle of from 60°–90°, to cause a plowing effect and rock chip flow along the cutter elements.

2. The improved drill bit as recited in claim 1 wherein the included angle of the V-shaped cutting elements is 75°.

* * * * *